US008342825B2

(12) United States Patent
Byun et al.

(10) Patent No.: US 8,342,825 B2
(45) Date of Patent: Jan. 1, 2013

(54) 2 STAGE ROTARY COMPRESSOR

(75) Inventors: Sang-Myung Byun, Changwon-shi (KR); Seung-Jun Lee, Changwon-shi (KR); Yun-Hi Lee, Gimhae-shi (KR); Yoon-Sung Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 370 days.

(21) Appl. No.: 12/741,908

(22) PCT Filed: Mar. 31, 2008

(86) PCT No.: PCT/KR2008/001796

§ 371 (c)(1), (2), (4) Date: Jul. 13, 2010

(87) PCT Pub. No.: WO2009/061038

PCT Pub. Date: May 14, 2009

(65) Prior Publication Data

US 2010/0278674 A1 Nov. 4, 2010

(30) Foreign Application Priority Data

Nov. 9, 2007 (KR) ..... 10-2007-0114571

(51) Int. Cl.
*F01C 1/30* (2006.01)
*F04C 2/00* (2006.01)
*F04C 11/00* (2006.01)

(52) U.S. Cl. ..... 418/7; 418/11; 418/86

(58) Field of Classification Search ..... 418/7, 11, 418/13, 15, 86

See application file for complete search history.

(56) References Cited

U.S. PATENT DOCUMENTS 5,322,424 A 6/1994 Fujio
6,616,428 B2 * 9/2003 Ebara et al. ..... 418/11

FOREIGN PATENT DOCUMENTS

JP 2000-009072 1/2000
JP 2006-177226 7/2006
JP 2007-113542 5/2007

OTHER PUBLICATIONS

International Search Report issued in PCT/KR2008/001796 dated Dec. 15, 2008.

* cited by examiner

*Primary Examiner* — Zelalem Eshete
(74) *Attorney, Agent, or Firm* — KED & Associates LLP

(57) ABSTRACT

The present invention provides a 2 stage rotary compressor (100) including a hermetic container (101), a 2 stage compression assembly provided in the hermetic container, wherein a low pressure compression assembly (120), a middle plate (130) and a high pressure compression assembly (140) are successively stacked from any one of upper and lower portions, a first discharge port (124) for discharging middle pressure refrigerant compressed in the low pressure compression assembly (120) a second discharge port (162*p*) for discharging high pressure refrigerant compressed in the high pressure compression assembly (130) and a third discharge port (172*p*) positioned at any one of the upper and lower portions of the 2 stage compression assembly to discharge high pressure refrigerant compressed in the 2 stage compression assembly to the hermetic container (101), wherein an area of the third discharge port (172*p*) is larger than 0.5 times of an area of the first discharge port and smaller than 1.0 times thereof. As a volume flow of refrigerant compressed in the low pressure compression assembly (120) determines a volume flow of refrigerant compressed in the entire 2 stage compression assembly, a size of the third discharge port discharging refrigerant compressed in the 2 stage compression assembly is preferably optimized at a ratio with respect to a size of the first discharge port (127). Therefore, the size of the third discharge port (172*p*) can be optimized to suppress noise of the compressor.

20 Claims, 14 Drawing Sheets

$A_1$ :Area of first discharge port a :Area of third discharge port ($a = a_1 + a_2$)

2 STAGE ROTARY COMPRESSOR

TECHNICAL FIELD

The present invention relates to a 2 stage rotary compressor, and more particularly, to a 2 stage rotary compressor, wherein a size of a discharge port of a muffler discharging refrigerant compressed in a 2 stage compression assembly to a hermetic container is restricted within a predetermined range.

BACKGROUND ART

In general, a compressor is a mechanical apparatus that receives power from a power generation apparatus such as an electric motor, a turbine or the like and compresses air, refrigerant or various operation gases to raise a pressure. The compressor has been widely used in an electric home appliance such as a refrigerator and an air conditioner, or in the whole industry.

The compressor is roughly classified into a reciprocating compressor wherein a compression space to/from which an operation gas is sucked and discharged is defined between a piston and a cylinder, and the piston is linearly reciprocated inside the cylinder to compress refrigerant, a rotary compressor wherein a compression space to/from which an operation gas is sucked and discharged is defined between an eccentrically-rotated roller and a cylinder, and the roller is eccentrically rotated along an inner wall of the cylinder to compress refrigerant, and a scroll compressor wherein a compression space to/from which an operation gas is sucked and discharged is defined between an orbiting scroll and a fixed scroll, and the orbiting scroll is rotated along the fixed scroll to compress refrigerant.

Particularly, the rotary compressor has been developed to a twin rotary compressor, wherein two rollers and two cylinders are provided at upper and lower portions, and the pairs of rollers and cylinders of the upper and lower portions compress some and the other of the entire compression capacity, and a 2 stage rotary compressor, wherein two rollers and two cylinders are provided at upper and lower portions, and the two cylinders communicate with each other so that one pair can compress relatively low pressure refrigerant and the other pair can compress relatively high pressure refrigerant passing through a low pressure compression step.

Korean Registered Patent Publication 1994-0001355 discloses a rotary compressor. An electric motor is positioned in a shell, and a rotation axis is installed to pass through the electric motor. In addition, a cylinder is positioned below the electric motor, and an eccentric portion fitted around the rotation axis and a roller fitted onto the eccentric portion are positioned in the cylinder. A refrigerant discharge hole and a refrigerant inflow hole are formed in the cylinder, and a vane for preventing non-compressed low pressure refrigerant from being mixed with compressed high pressure refrigerant is installed between the refrigerant discharge hole and the refrigerant inflow hole. Moreover, a spring is installed at one end of the vane so that the eccentrically-rotated roller and the vane can be continuously in contact with each other. When the rotation axis is rotated by the electric motor, the eccentric portion and the roller are rotated along the inner circumference of the cylinder to compress refrigerant gas, and the compressed refrigerant gas is discharged through the refrigerant discharge hole.

Korean Laid-Open Patent Publication 10-2005-0062995 suggests a twin rotary compressor. Referring to FIG. 1, two cylinders 1035 and 1045 for compressing the same capacity and a middle plate 1030 are provided to improve a compression capacity twice as much as that of an 1 stage compressor.

Korean Laid-Open Patent Publication 10-2007-0009958 teaches a 2 stage rotary compressor. As illustrated in FIG. 2, a compressor 2001 includes an electric motor 2014 having a stator 2007 and a rotor 2008 at an inside upper portion of a hermetic container 2013, and a rotation axis 2002 connected to the electric motor 2014 includes two eccentric portions. A main bearing 2009, a high pressure compression element 2020*b*, a middle plate 2015, a low pressure compression element 2020*a* and a sub bearing 2019 are successively stacked from the side of the electric motor 2014 with respect to the rotation axis 2002. In addition, a middle tube 2040 is installed to introduce refrigerant compressed in the low pressure compression element 2020*a* into the high pressure compression element 2020*b*.

In the conventional twin rotary compressor, an area of a discharge port formed in a muffler is equal to the sum of areas of respective discharge ports discharging refrigerant compressed in the two cylinders. Moreover, in the conventional 2 stage rotary compressor, an area of a discharge port formed in a muffler is equal to or larger than the sum of areas of a first discharge port and a second discharge port, or equal to or larger than the double of the area of the first discharge port as in the twin rotary compressor. Accordingly, a volume flow of refrigerant discharged in a discharge stroke of a 2 stage compression assembly of the 2 stage rotary compressor, and the area of the discharge port of the muffler are not optimized to thereby entirely increase a noise spectrum.

DISCLOSURE OF INVENTION

Technical Problem

An object of the present invention is to provide a 2 stage rotary compressor which can reduce noise.

Another object of the present invention is to provide a 2 stage rotary compressor, wherein an area of a discharge port discharging refrigerant compressed in a 2 stage compression assembly to a hermetic container is restricted to have a ratio within a pre-determined range with respect to an area of a discharge port discharging middle pressure refrigerant compressed in a low pressure compression assembly.

A further object of the present invention is to provide a 2 stage rotary compressor including a muffler, wherein an area of a discharge port formed in the muffler exists within a predetermined range.

Technical Solution

According to the present invention, there is provided a 2 stage rotary compressor, including: a hermetic container; a 2 stage compression assembly provided in the hermetic container, wherein a low pressure compression assembly, a middle plate and a high pressure compression assembly are successively stacked from any one of upper and lower portions; a first discharge port for discharging middle pressure refrigerant compressed in the low pressure compression assembly; a second discharge port for discharging high pressure refrigerant compressed in the high pressure compression assembly; and a third discharge port positioned at any one of the upper and lower portions of the 2 stage compression assembly to discharge high pressure refrigerant compressed in the 2 stage compression assembly to the hermetic container, wherein an area of the third discharge port is larger than 0.5 times of an area of the first discharge port and smaller than 1.0 times thereof. As a volume flow of refrigerant compressed in the low pressure compression assembly determines a volume flow of refrigerant compressed in the entire 2 stage compression assembly, it is preferable that a size of the third discharge port discharging refrigerant compressed in the entire 2 stage compression assembly has a ratio with respect to a size of the first discharge port. Accordingly, in this configuration, the size of the third discharge port can be optimized to suppress noise of the compressor.

According to one aspect of the present invention, the 2 stage rotary compressor further includes a muffler positioned on the 2 stage compression assembly to temporarily store refrigerant discharged from the second discharge port, wherein the third discharge port is formed in the muffler. In this configuration, vibration and noise can be reduced before high pressure refrigerant compressed in the 2 stage compression assembly is discharged to the hermetic container.

According to another aspect of the present invention, the muffler includes a bearing and a cover. In this configuration, the muffler is composed of the bearing for fixing and supporting the 2 stage compression assembly in the hermetic container and the cover for covering the bearing, so that a size of the compressor can be reduced.

According to a further aspect of the present invention, two or more third discharge ports are formed. In this configuration, high pressure refrigerant is discharged to the hermetic container through the plurality of discharge ports, so that vibration and noise can be considerably reduced.

According to a still further aspect of the present invention, the 2 stage rotary compressor further includes a passage for guiding middle pressure refrigerant discharged through the first discharge port to the high pressure compression assembly.

According to a still further aspect of the present invention, the passage is defined by a U-shaped tube passing through the hermetic container.

According to a still further aspect of the present invention, the passage is an inner passage defined by a hole processed in the 2 stage compression assembly. In this configuration, middle pressure refrigerant passes through the inner passage, so that vibration and noise of the compressor can be remarkably reduced.

According to a still further aspect of the present invention, the 2 stage rotary compressor further includes an injection tube coupled to the passage.

In addition, according to the present invention, there is provided a 2 stage rotary compressor, including: a hermetic container; a 2 stage compression assembly provided in the hermetic container, wherein a low pressure compression assembly, a middle plate and a high pressure compression assembly are successively stacked from any one of upper and lower portions; a first discharge port for discharging middle pressure refrigerant compressed in the low pressure compression assembly; a second discharge port for discharging high pressure refrigerant compressed in the high pressure compression assembly; and a third discharge port positioned at any one of the upper and lower portions of the 2 stage compression assembly to discharge high pressure refrigerant compressed in the 2 stage compression assembly to the hermetic container, wherein an area of the third discharge port is larger than 0.5 times of an area of the second discharge port and smaller than 1.0 times thereof.

A diameter of the second discharge port is equivalent to 0.5 to 1.0 times of a diameter of the first discharge port.

Moreover, according to the present invention, there is provided a 2 stage rotary compressor, including: a hermetic container; a low pressure cylinder provided in the hermetic container to define a space of compressing low pressure refrigerant; a high pressure cylinder provided in the hermetic container to define a space of compressing middle pressure refrigerant compressed in the low pressure cylinder; a muffler formed in the shape of a cap and coupled to the high pressure cylinder to reduce noise of compressed high pressure refrigerant; a middle pressure discharge hole formed in the low pressure cylinder to discharge refrigerant compressed to a middle pressure; and a high pressure discharge hole formed in the muffler, and larger than 0.5 times of an area of the middle pressure discharge hole and smaller than 1.0 times thereof.

According to one aspect of the present invention, the high pressure discharge hole formed in the muffler is formed in a plural number, and the sum of areas of the high pressure discharge holes is larger than 0.5 times of the area of the middle pressure discharge hole and smaller than 1.0 times thereof.

According to another aspect of the present invention, the middle pressure discharge hole communicates with the compression space of the high pressure cylinder.

According to a further aspect of the present invention, the middle pressure discharge hole and the compression space of the high pressure cylinder communicate with each other by means of a U-shaped tube passing through the hermetic container.

According to a still further aspect of the present invention, the 2 stage rotary compressor further includes a middle plate positioned between the low pressure cylinder and the high pressure cylinder, wherein the middle pressure discharge hole and the compression space of the high pressure cylinder communicate with each other by means of a hole formed in the middle plate.

Further, according to the present invention, there is provided a 2 stage rotary compressor, including: a hermetic container; a low pressure cylinder provided in the hermetic container to define a space of compressing low pressure refrigerant; a high pressure cylinder provided in the hermetic container to define a space of compressing middle pressure refrigerant compressed in the low pressure cylinder; a muffler formed in the shape of a cap and coupled to the high pressure cylinder to reduce noise of compressed high pressure refrigerant; a high pressure discharge hole formed in the high pressure cylinder to discharge refrigerant compressed to a high pressure; and a high pressure discharge hole formed in the muffler, and larger than 0.5 times of an area of the high pressure discharge hole formed in the high pressure cylinder and smaller than 1.0 times thereof.

According to one aspect of the present invention, the 2 stage rotary compressor further includes a middle pressure discharge hole formed in the low pressure cylinder to discharge refrigerant compressed to a middle pressure, wherein a diameter of the high pressure discharge hole formed in the high pressure cylinder has a value between 0.5 and 1.0 times of a diameter of the middle pressure discharge hole.

According to another aspect of the present invention, the middle pressure discharge hole communicates with the compression space of the high pressure cylinder.

According to a further aspect of the present invention, the middle pressure discharge hole and the compression space of the high pressure cylinder communicate with each other by means of a U-shaped tube passing through the hermetic container.

According to a still further aspect of the present invention, the 2 stage rotary compressor further includes a middle plate positioned between the low pressure cylinder and the high pressure cylinder, wherein the middle pressure discharge hole and the compression space of the high pressure cylinder communicate with each other by means of a hole formed in the middle plate.

Advantageous Effects

According to a 2 stage rotary compressor of the present invention, an area of a third discharge port discharging high pressure refrigerant compressed in a 2 stage compression assembly to a hermetic container can be optimized to suppress noise of the compressor.

In addition, according to a 2 stage rotary compressor of the present invention, an area of a third discharge port has a ratio within a predetermined range with respect to an area of a first discharge port discharging refrigerant compressed in a low pressure compression assembly. Therefore, the area of the third discharge port can be optimized, corresponding to the area of the first discharge port determining the entire compression capability of the 2 stage compressor.

MODE FOR THE INVENTION

Hereinafter, preferred embodiments of the present invention will be described in detail with reference to the accompanying drawings.

Figure 1:
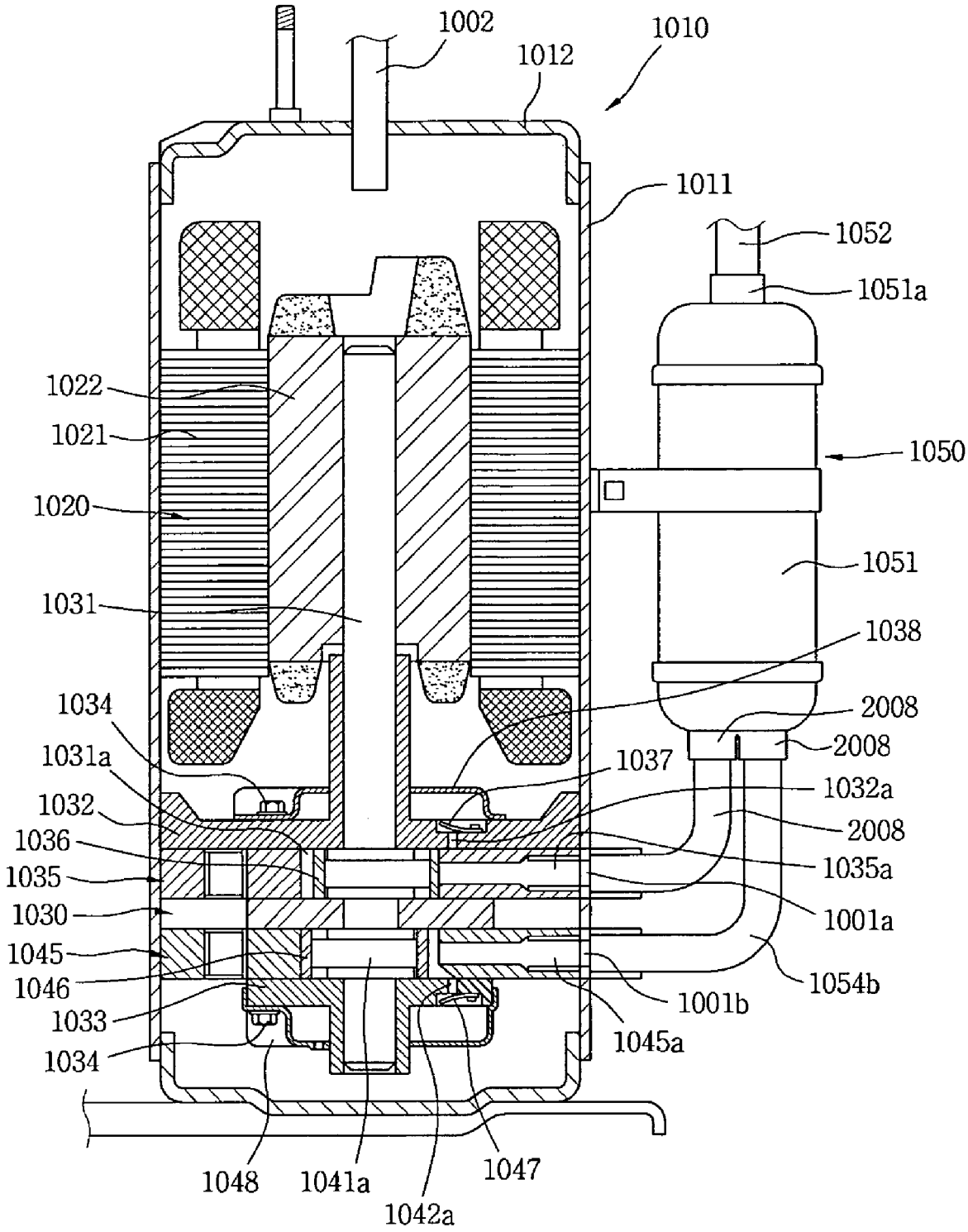
FIG. 1 is a view illustrating one example of a conventional twin rotary compressor.
Figure 2:
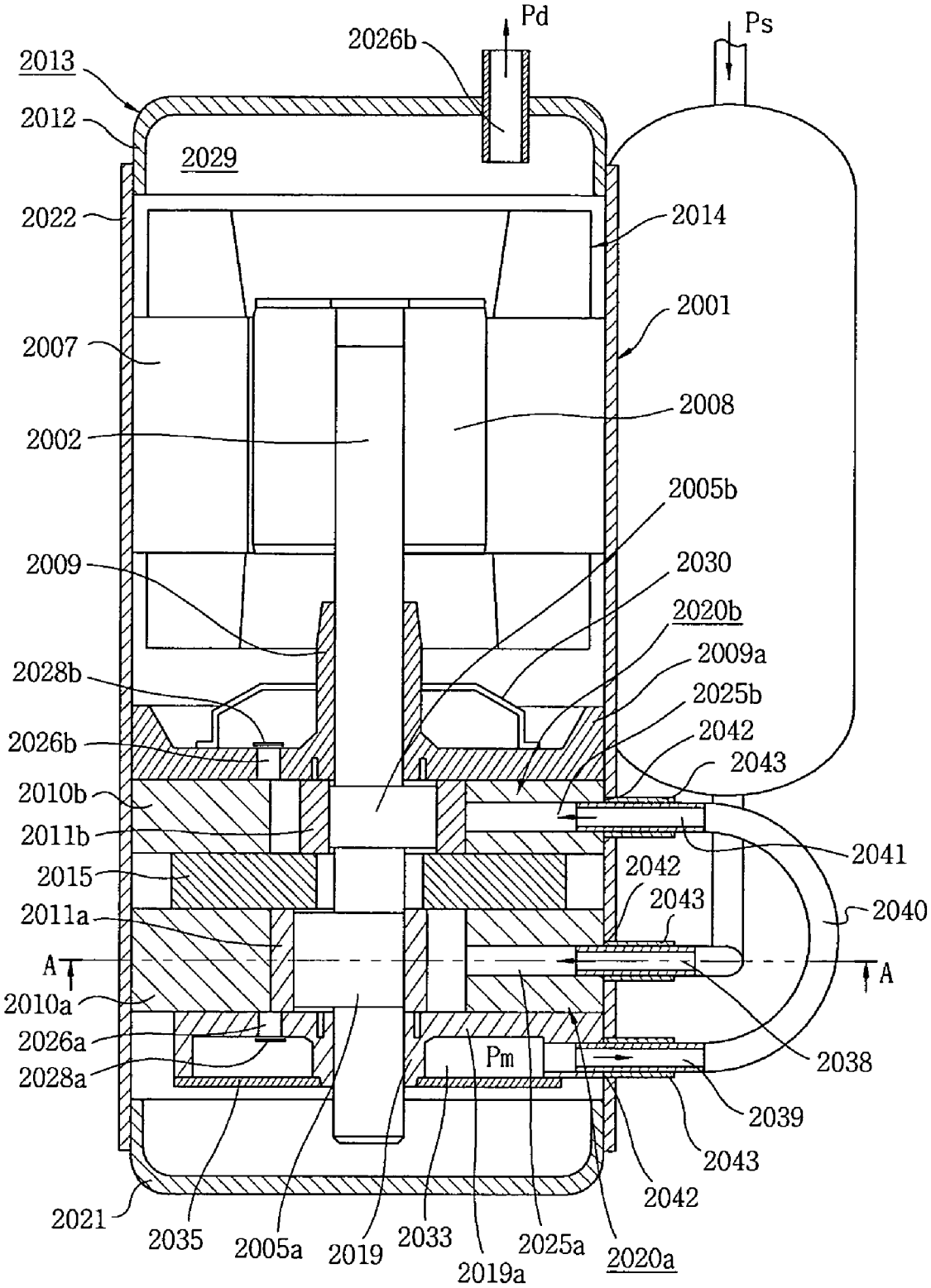
FIG. 2 is a view illustrating one example of a conventional 2 stage rotary compressor.
Figure 3:
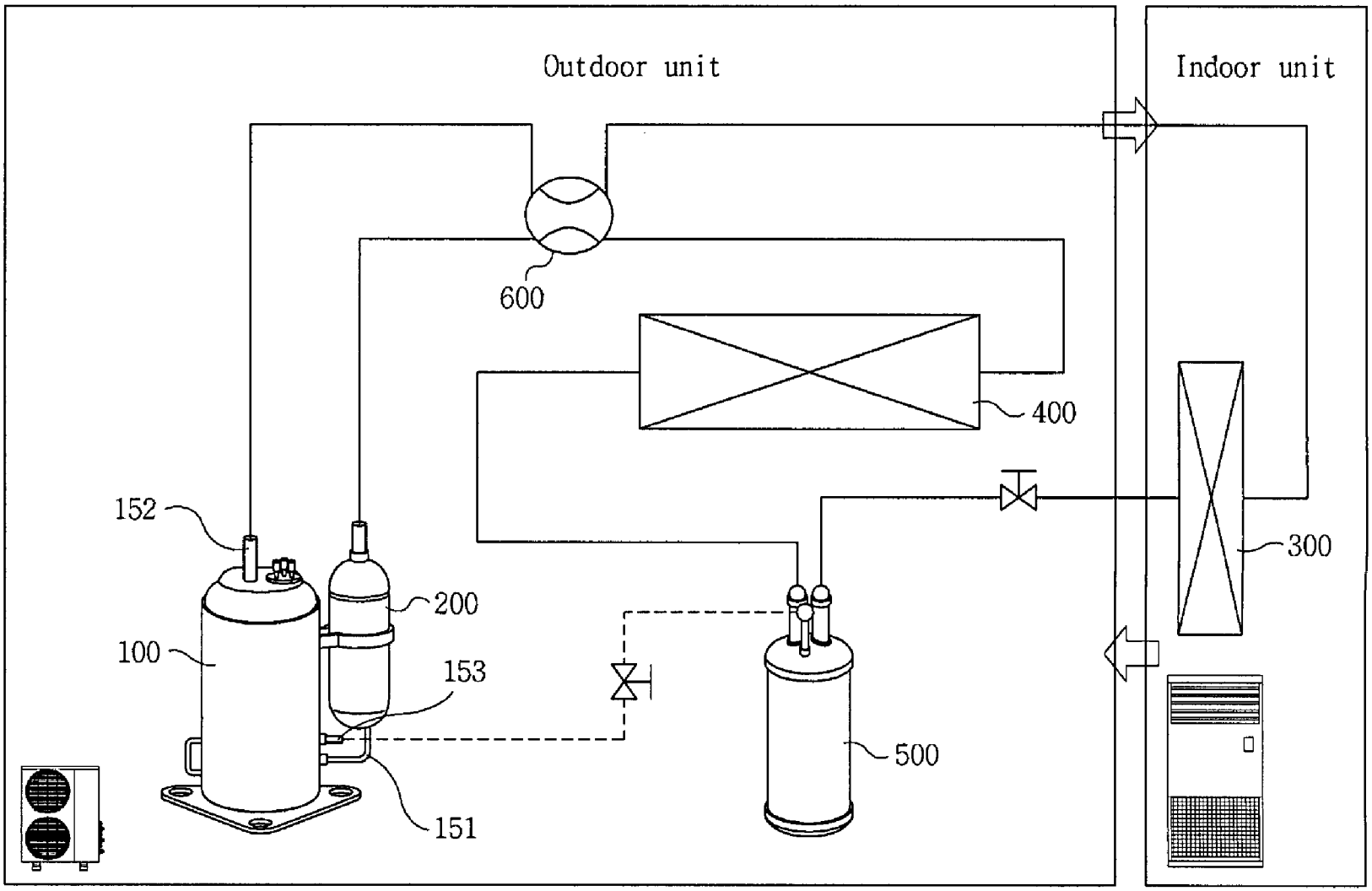
FIG. 3 is a schematic view illustrating one example of a cycle including a 2 stage rotary compressor.

FIG. 3 is a schematic view illustrating one example of a freezing cycle constructed by a 2 stage rotary compressor. The freezing cycle includes a 2 stage rotary compressor 100, a condenser 300, an evaporator 400, a phase separator 500, a 4 way valve 600, etc. The condenser 300 constitutes an indoor unit, and the compressor 100, the evaporator 400 and the phase separator 500 constitute an outdoor unit. Refrigerant compressed in the compressor 100 is introduced into the condenser 300 through the 4 way valve 600. The compressed refrigerant gas exchanges heat with the ambient air and is condensed. The condensed refrigerant becomes a low pressure through an expansion valve. The refrigerant passing through the expansion valve is separated into gas and liquid in the phase separator 500. The liquid flows into the evaporator 400. The liquid is heat-exchanged and evaporated in the evaporator 400, introduced into an accumulator 200 in a gas phase, and transferred from the accumulator 200 to a low pressure compression assembly (not shown) through a refrigerant inflow tube 151 of the compressor 100. In addition, the gas separated in the phase separator 500 is introduced into the compressor 100 through an injection tube 153. Middle pressure refrigerant compressed in the low pressure compression assembly of the compressor 100 and refrigerant transferred through the injection tube 153 are supplied to a high pressure compression assembly (not shown) of the compressor, compressed to a high pressure, and discharged to the outside of the compressor 100 through a refrigerant discharge tube 152.

Figure 4:
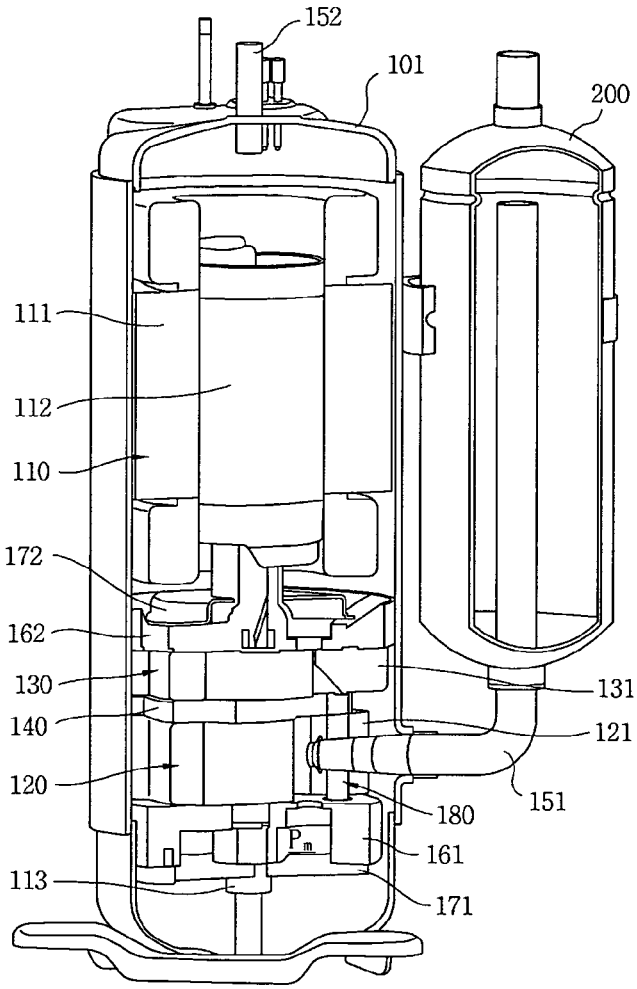
FIG. 4 is a view illustrating a 2 stage rotary compressor according to one embodiment of the present invention.

FIG. 4 is a view illustrating a 2 stage rotary compressor according to one embodiment of the present invention. A 2 stage rotary compressor 100 according to one embodiment of the present invention includes a low pressure compression assembly 120, a middle plate 140, a high pressure compression assembly 130 and an electric motor 110 in a hermetic container 101 from the bottom. In addition, the 2 stage rotary compressor 100 includes a refrigerant inflow tube 151 connected to an accumulator 200, and a refrigerant discharge tube 152 for discharging compressed refrigerant to the outside of the hermetic container 101, which pass through the hermetic container 101.

The electric motor 110 includes a stator 111, a rotor 112 and a rotation axis 113. The stator 111 has a lamination of ring-shaped electronic steel plates and a coil wound around the lamination. The rotor 112 also has a lamination of electronic steel plates. The rotation axis 113 passes through a center of the rotor 112 and is fixed to the rotor 112. When a current is applied to the electric motor 110, the rotor 112 is rotated due to a mutual electromagnetic force between the stator 111 and the rotor 112, and the rotation axis 113 fixed to the rotor 112 is rotated with the rotor 112. The rotation axis 113 is extended from the rotor 112 to the low pressure compression assembly 120 to pass through the central portions of the low pressure compression assembly 120, the middle plate 140 and the high pressure compression assembly 130.

The low pressure compression assembly 120 and the high pressure compression assembly 130 may be stacked with the middle plate 140 positioned therebetween in the order of the low pressure compression assembly 120—the middle plate 140—the high pressure compression assembly 130 from the bottom. On the contrary, the low pressure compression assembly 120 and the high pressure compression assembly 130 may be stacked in the order of the high pressure compression assembly 130—the middle plate 140—the low pressure compression assembly 120 from the bottom. In addition, a lower bearing 161 and an upper bearing 162 are installed under and on the stacked assembly, regardless of the stacked order of the low pressure compression assembly 120, the middle plate 140 and the high pressure compression assembly 130 so as to facilitate the rotation of the rotation axis 113 and support load of respective vertically-stacked components of the 2 stage compression assembly. The upper bearing 162 is fixed to the hermetic container 101 by means of 3-spot welting so as to support the load of the 2 stage compression assembly.

The refrigerant inflow tube 151 passing through the hermetic container 101 from the outside is connected to the low pressure compression assembly 120. Moreover, the lower bearing 161 and a lower cover 171 are positioned under the low pressure compression assembly 120. A middle pressure chamber $P_m$ is defined between the lower bearing 161 and the lower cover 171. The middle pressure chamber $P_m$ is a space to which refrigerant compressed in the low pressure compression assembly 120 is discharged, and a space in which refrigerant is temporarily stored before it is introduced into the high pressure compression assembly 130. The middle pressure chamber $P_m$ serves as a buffering space on a passage of flowing refrigerant from the low pressure compression assembly 120 to the high pressure compression assembly 130.

A discharge port (not shown) is formed in an upper portion of the upper bearing 162 positioned on the high pressure compression assembly 130. High pressure refrigerant discharged from the high pressure compression assembly 130 through the discharge port of the upper bearing 162 is discharged to the outside through the refrigerant discharge tube 152 positioned at an upper portion of the hermetic container 101.

An inner passage 180 connected to cause refrigerant to flow from the low pressure compression assembly 120 to the high pressure compression assembly 130 is formed in the lower bearing 161, the low pressure compression assembly 120, the middle plate 140 and the high pressure compression assembly 130. The inner passage 180 is vertically formed to be parallel with an axis direction of the compressor 100.

Figure 5:
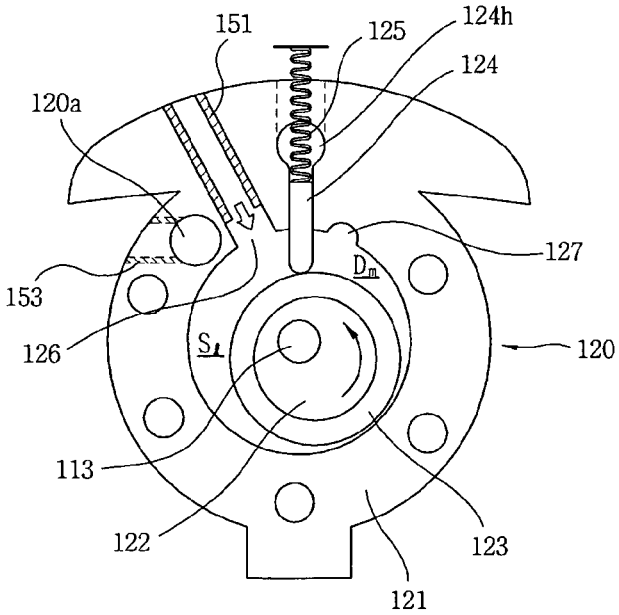
FIG. 5 is a view illustrating a low pressure compression assembly of the 2 stage rotary compressor according to one embodiment of the present invention.

FIG. 5 is a sectional view illustrating the low pressure compression assembly 120. The low pressure compression assembly 120 includes a low pressure cylinder 121, a low pressure eccentric portion 122, a low pressure roller 123, a low pressure vane 124, a low pressure elastic member 125, a low pressure inflow hole 126, and a middle pressure discharge hole 127. The rotation axis 113 passes through a central portion of the low pressure cylinder 121, and the low pressure eccentric portion 122 is fixed to the rotation axis 113. Here, the low pressure eccentric portion 122 may be integrally formed with the rotation axis 113. In addition, the low pressure roller 123 is rotatably installed on the low pressure eccentric portion 122, so that the low pressure roller 123 is rolled and rotated along an inner diameter of the low pressure cylinder 121 due to the rotation of the rotation axis 113. The low pressure inflow hole 126 and the middle pressure discharge hole 127 are formed at both sides of the low pressure vane 124. Moreover, a space inside the low pressure cylinder 121 is partitioned off by the low pressure vane 124 and the low pressure roller 123, so that refrigerant before compression and refrigerant after compression coexist in the low pressure cylinder 121. A portion partitioned by the low pressure vane 124 and the low pressure roller 123 and including the low pressure inflow hole 126 is referred to as a low pressure refrigerant inflow portion $S_1$, and a portion including the middle pressure discharge hole 127 is referred to as a middle pressure refrigerant discharge portion $D_m$. At this time, the low pressure elastic member 125 is a means for applying force to the low pressure vane 124 so that the low pressure vane 124 can be continuously in contact with the low pressure roller 123. A vane hole **124*h* formed in the low pressure cylinder 121 to position the low pressure vane 124 therein penetrates through the low pressure cylinder 121 in a horizontal direction. The low pressure vane 124 is guided through the vane hole 124*h*, and the low pressure elastic member 125 imparting force to the low pressure vane 124 passes through the low pressure cylinder 121 and extends to the hermetic container 101 through the vane hole 124*h*. One end of the low pressure elastic member 125 contacts the low pressure vane 124 and the other end thereof contacts the hermetic container 101 to push the low pressure vane 124 to be continuously in contact with the low pressure roller 123**.

In addition, a middle pressure communication hole **120*a* is formed in the low pressure cylinder 121 so that refrigerant compressed in the low pressure compression assembly 120 can be introduced into the high pressure compression assembly 130 via the middle pressure chamber $P_m$ defined by the lower bearing 161. The middle pressure communication hole 120*a* is formed to avoid the refrigerant inflow tube 151 so that the middle pressure communication hole 120*a* can not overlap with the refrigerant inflow tube 151 inserted into the low pressure inflow hole 126, i.e., the inner passage 180 can not overlap with the refrigerant inflow tube 151. Even if the middle pressure communication hole 120*a* partially overlaps with the refrigerant inflow tube 151, it causes middle pressure refrigerant to flow from the middle pressure chamber $P_m$ to the high pressure compression assembly 130. However, in this case, a loss may occur as much as a sectional area of the inner passage 180 overlapping with the refrigerant inflow tube 151. In addition, since refrigerant bypasses the refrigerant inflow tube 151**, a pressure may be lowered.

As shown in FIG. 5, when the low pressure eccentric portion 122 is rotated due to the rotation of the rotation axis 113 and the low pressure roller 123 is rolled along the low pressure cylinder 121, a volume of the low pressure inflow portion $S_1$ is increased, so that the low pressure inflow portion $S_1$ has a low pressure. Therefore, refrigerant is introduced through the low pressure inflow hole 126. Meanwhile, a volume of the middle pressure discharge portion $D_m$ is decreased, so that refrigerant filled in the middle pressure discharge portion $D_m$ is compressed and discharged through the middle pressure discharge hole 127. The volumes of the low pressure inflow portion $S_1$ and the middle pressure discharge portion $D_m$ are continuously changed according to the rotation of the low pressure eccentric portion 122 and the low pressure roller 123, and compressed refrigerant is discharged in every one rotation.

Figure 6:
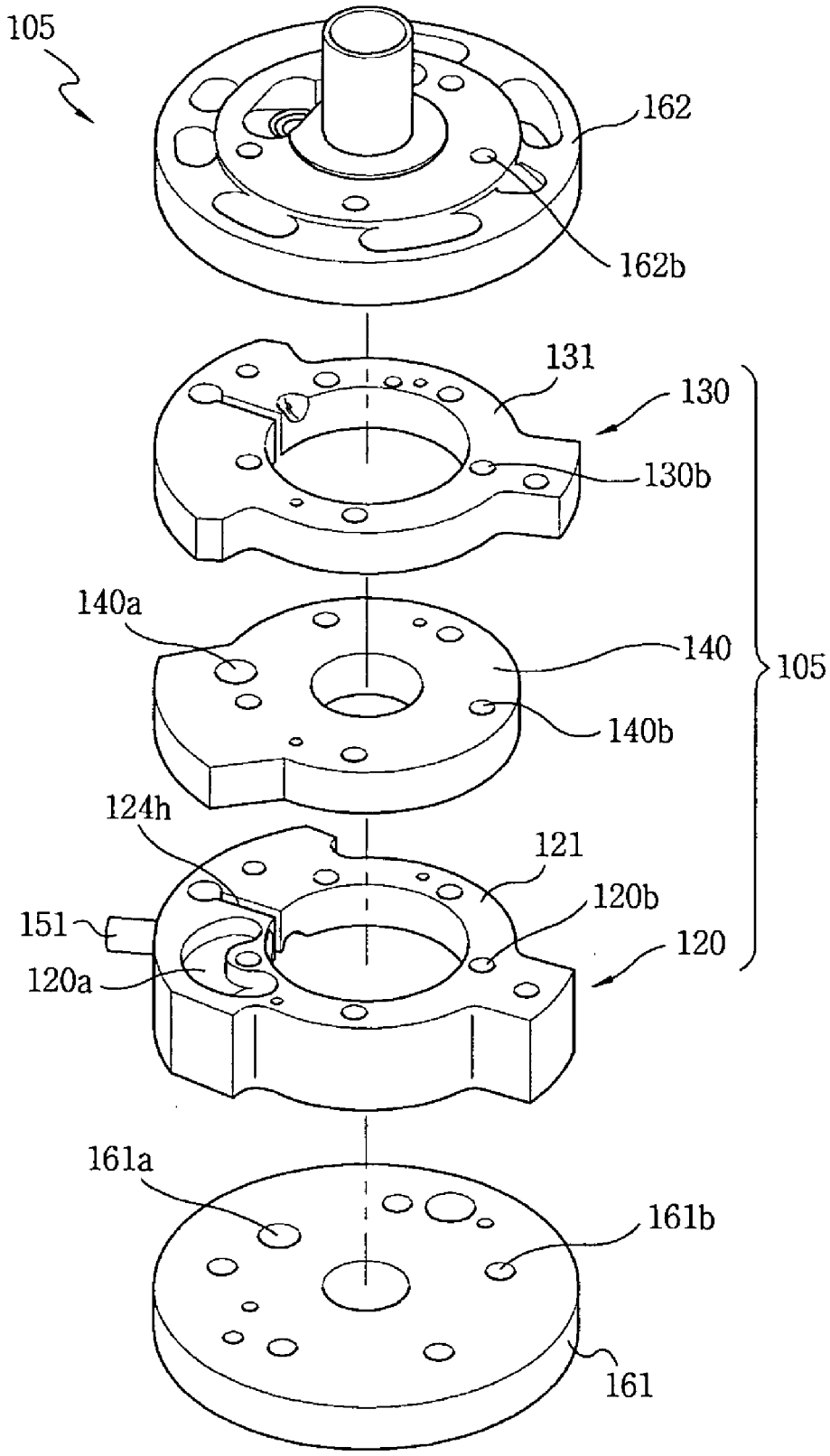
FIGS. 6 and 7 are views illustrating portions of the 2 stage rotary compressor according to one embodiment of the present invention, seen from the top and bottom, respectively.
Figure 7:
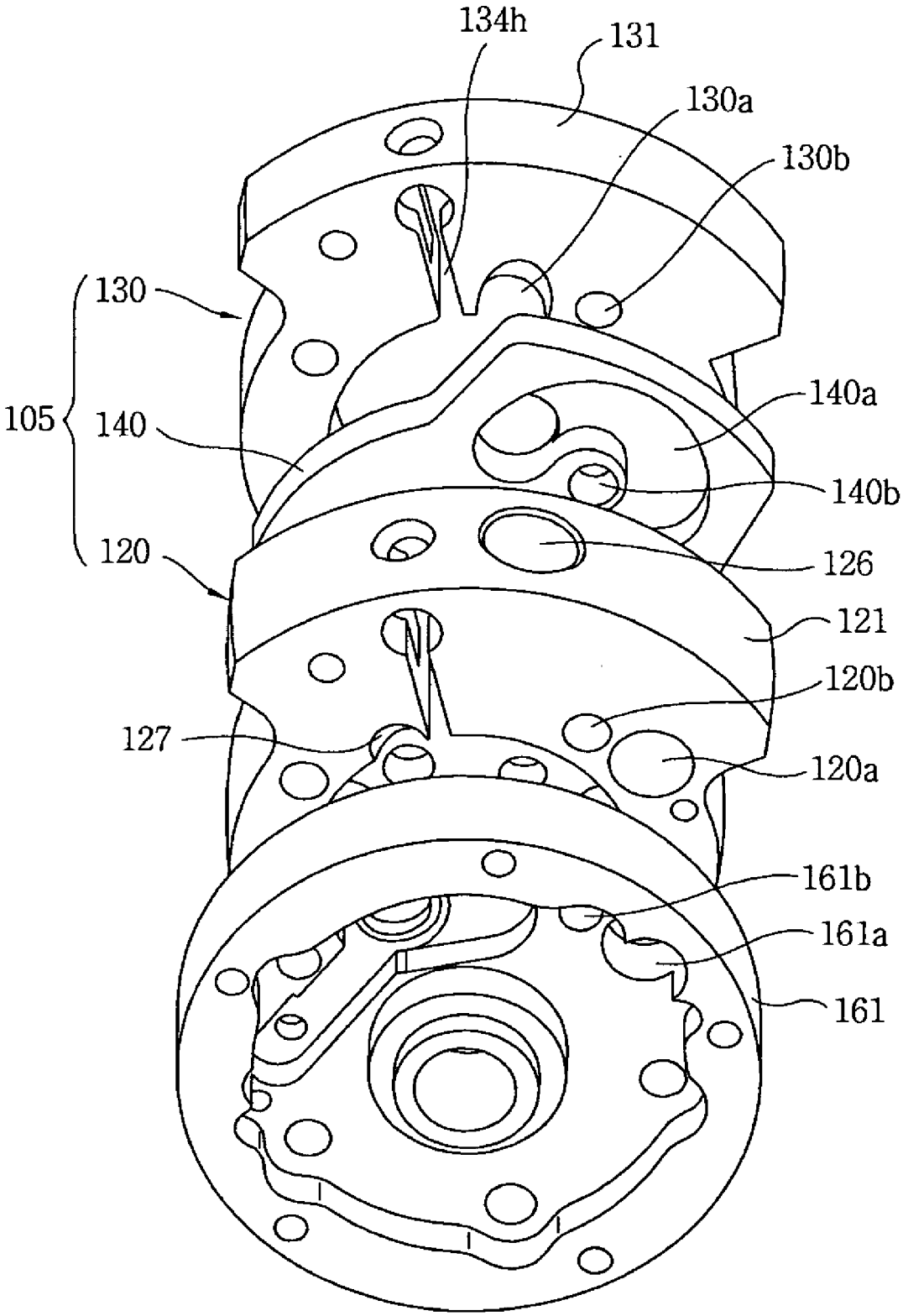
Figure 8:
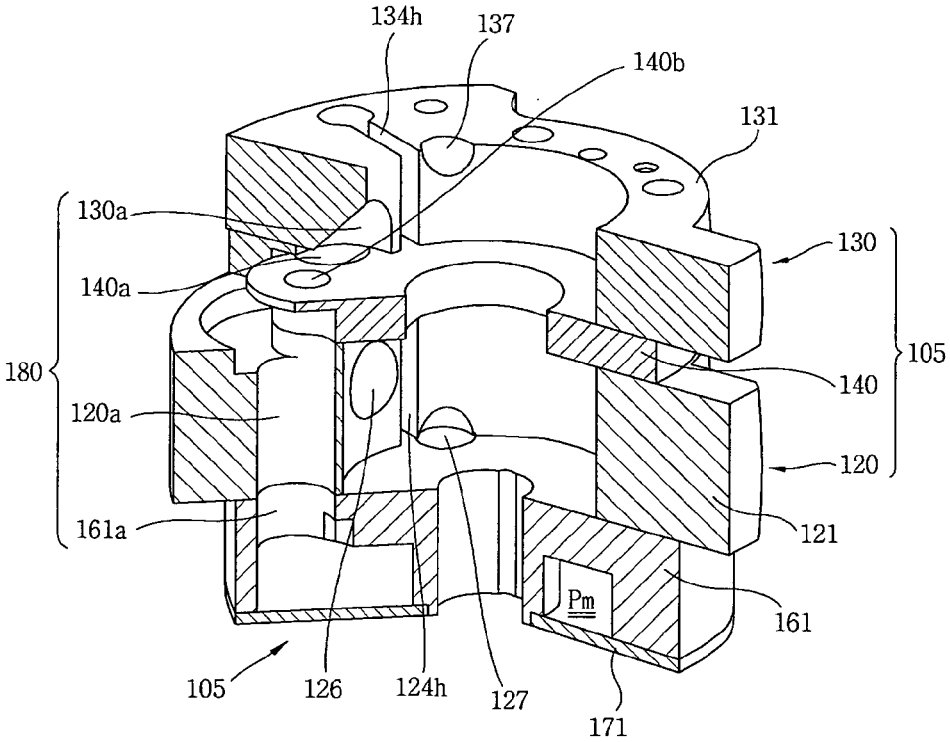
FIG. 8 is a cutaway view illustrating the 2 stage rotary compressor according to one embodiment of the present invention.

FIGS. 6 to 8 are views illustrating portions of the 2 stage rotary compressor according to one embodiment of the present invention. The lower bearing 161, the low pressure compression assembly 120, the middle plate 140 and the high pressure compression assembly 130 are successively stacked from the bottom. As described above, low pressure refrigerant is introduced into the low pressure cylinder 121 through the refrigerant inflow tube 151 and the low pressure inflow hole 126, compressed, and discharged to the middle pressure chamber $P_m$ which is a space restricted by a bottom surface of the low pressure compression assembly 120, the lower bearing 161 and the lower cover 171 through the middle pressure discharge hole 127. A middle pressure discharge hole **161*h* is formed in the lower bearing 161 to overlap with the middle pressure discharge hole 127, and a valve (not shown) is installed under the middle pressure discharge hole 161*h* of the lower bearing 161. When refrigerant compressed in the middle pressure discharge portion $D_m$ of the low pressure compression assembly 120 is compressed to a predetermined pressure, it is discharged to the middle pressure chamber $P_m$. The refrigerant discharged to the middle pressure chamber $P_m$ is introduced into the high pressure compression assembly 130 via the middle pressure communication hole 161***a* formed in the lower bearing 161, the middle pressure communication hole 120*a* formed in the low pressure cylinder 121, a middle pressure communication hole 140*a* formed in the middle plate 140 and a middle pressure inflow groove 130*a* formed in the high pressure cylinder 131. The middle pressure communication hole 161*a* of the lower bearing 161, the middle pressure communication hole 120*a* of the low pressure compression assembly 120, the middle pressure communication hole 140*a* of the middle plate 140 and the middle pressure inflow groove 130*a* of the high pressure compression assembly 130 define the inner passage 180 for middle pressure refrigerant compressed in the low pressure compression assembly 120. Here, the middle pressure inflow groove 130*a* of the high pressure compression assembly 130 is formed in the shape of an inclined groove to communicate with an inner space of the high pressure cylinder 131. Some lower portion of the middle pressure inflow groove 130*a* is in contact with the middle pressure communication hole 140*a* of the middle plate 140 to be a part of the inner passage 180. Compressed middle pressure refrigerant is introduced into the high pressure cylinder 131 through the middle pressure inflow groove 130*a*. When middle pressure refrigerant is supplied to the high pressure compression assembly 130 through the inner passage 180, the high pressure compression assembly 130 compresses the middle pressure refrigerant to a high pressure in the same operation principle as that of the low pressure compression assembly 120.

As set forth above, when the inner passage 180 for middle pressure refrigerant is not defined by a separate tube but formed in the hermetic container 101, noise can be suppressed and a length of the inner passage 180 can be reduced, so that a refrigerant pressure loss caused by a resistance can be reduced. In the above description, although the middle pressure chamber $P_m$ is formed at the lower bearing 161, it may be formed at any one of the upper bearing 162 and the middle plate 140. Accordingly, detailed configuration may be slightly changed. However, in every case, the inner passage 180 is formed in the 2 stage compression assembly to guide middle pressure refrigerant compressed in the middle pressure compression assembly 120 to the high pressure compression assembly 130. In this configuration, since a length of the passage for guiding middle pressure refrigerant is reduced, a flow loss can be minimized, and since refrigerant does not pass through a connection tube passing through the hermetic container 101, noise and vibration can be suppressed.

Here, in order to prevent the inner passage 180 from being blocked by the refrigerant inflow tube 151, the middle pressure communication hole 120*a* of the low pressure compression assembly 120, the middle pressure communication hole 140*a* of the middle plate 140 and the middle pressure inflow groove 130*a* of the high pressure compression assembly 130 constituting the inner passage 180 are spaced apart from the refrigerant inflow tube 151, as seen in an axis direction of the compressor 100.

The middle pressure communication hole 161*a* of the lower bearing 161 is formed to avoid an insertion position of the refrigerant inflow tube 151 connected to the low pressure cylinder 121 so that the middle pressure communication hole 161*a* can not be blocked by the refrigerant inflow tube 151. The refrigerant inflow tube 151 is inserted into the low pressure inflow hole 126 formed in the low pressure cylinder 121. The low pressure inflow hole 126 is adjacent to the low pressure vane insertion hole 124*h* into which the low pressure vane 124 (see FIG. 5) is to be inserted. As the low pressure inflow hole 126 is distant from the low pressure vane 124 (shown in FIG. 5), a dead volume which does not contribute to compression of refrigerant is increased in an inner space of the low pressure cylinder 121.

In addition, the middle pressure inflow groove 130*a* of the high pressure cylinder 131 is not formed from the lower to upper portions of the high pressure cylinder 131, but inclinedly formed from the lower portion to the inner space of the high pressure cylinder 131. Here, the middle pressure inflow groove 130*a* is adjacent to a high pressure vane hole 134*h* into which a high pressure vane (not shown) is to be inserted. As in the low pressure compression assembly 120, when the middle pressure inflow groove 130*a* is adjacent to the high pressure vane (not shown), a dead volume is reduced in the inner space of the high pressure cylinder 131.

The low pressure vane 124 and the high pressure vane (not shown) are positioned on the same axis. Accordingly, the middle pressure communication hole 161*a* formed in the lower bearing 161 and the middle pressure inflow groove 130*a* formed in the high pressure cylinder 131 are not formed on the same axis, but spaced apart from each other in a horizontal direction. According to a third embodiment of the present invention, the middle pressure communication hole 120*a* of the low pressure cylinder 121 and the middle pressure communication hole 140*a* of the middle plate 140 are formed in a spiral shape to connect the middle pressure communication hole 161*a* of the lower bearing 161 to the middle pressure inflow groove 130*a* of the high pressure cylinder 131. The middle pressure communication hole 120*a* of the low pressure cylinder 121 and the middle pressure communication hole 140*a* of the middle plate 140 are formed in a spiral shape to overlap with each other. That is, the middle pressure communication hole 120*a* of the low pressure cylinder 121 and the middle pressure communication hole 140*a* of the middle plate 140 overlap with each other to define a spiral communication hole. At this time, one end of the spiral communication hole overlaps with the middle pressure communication hole 161*a* of the lower bearing 161, and the other end thereof overlaps with the middle pressure inflow groove 130*a* of the high pressure cylinder 131. Here, one end of the middle pressure communication hole 120*a* of the low pressure cylinder 121 is connected to the middle pressure communication hole 161*a* of the lower bearing 161. That is, one end of the middle pressure communication hole 120*a* of the low pressure cylinder 121 which is in contact with the middle pressure communication hole 161*a* of the lower bearing 161 is formed in a vertical direction of the low pressure cylinder 121, and the other portion of the middle pressure communication hole 120*a* is entirely formed in a spiral shape as a bottom end thereof is gradually heightened from one end to the other end. On the contrary, the other end of the middle pressure communication hole 140*a* of the middle plate 140, i.e., the other end of the spiral communication hole overlapping with the middle pressure inflow groove 130*a* of the high pressure cylinder 131 is formed in a vertical direction of the middle plate 140. In addition, the middle pressure communication hole 140*a* is entirely formed in a spiral shape as a top end thereof is gradually heightened from one end overlapping with the middle pressure communication hole 161*a* of the lower bearing 161 to the other end.

In a case where the middle pressure communication hole 120*a* of the low pressure cylinder 121 and the middle pressure communication hole 140*a* of the middle plate 140 are formed in a spiral shape, when refrigerant flows through the middle pressure communication hole 120*a* of the low pressure cylinder 121 and the middle pressure communication hole 140*a* of the middle plate 140, a resistance imparted to the refrigerant is reduced. Meanwhile, the middle pressure communication hole 120*a* of the low pressure cylinder 121 and the middle pressure communication hole 140*a* of the middle plate 140 may be formed in a circular arc shape with a constant top or bottom end height as well as in a spiral shape.

Moreover, when the middle pressure communication hole 120*a* of the low pressure cylinder 121 and the middle pressure communication hole 140*a* of the middle plate 140 are formed in a spiral or circular arc shape, fastening holes 120*b* and 140*b* may be formed in central portions of the spiral or circular arc-shaped middle pressure communication holes 120*a* and 140*a*. Normally, the lower bearing 161, the low pressure cylinder 121, the middle plate 140, the high pressure cylinder 131 and the upper bearing 162 are fastened by means of bolts. Here, bolt fastening holes 161*b*, 120*b*, 130*b*, 140*b* and 162*b* should be formed to avoid various members and the inner passage, such as the refrigerant inflow tube 151, the middle pressure communication holes 161*a*, 120*a*, 140*a* and 162*a*, the middle pressure inflow groove 130*a* and the middle pressure discharge hole 127. In addition, the fastening holes 161*b*, 120*b*, 130*b*, 140*b* and 162*b* should be formed in at least three positions to evenly disperse a fastening force to the entire compression assembly 105. At this time, the middle pressure communication hole 120*a* of the low pressure cylinder 121 and the middle pressure communication hole 140*a* of the middle plate 140 are longer than the middle pressure communication hole 161*a* of the lower bearing 161 and the middle pressure inflow groove 130*a* of the high pressure cylinder 131, which makes it difficult to form the fastening holes 161*b*, 120*b*, 130*b*, 140*b* and 162*b* in a plural number. Accordingly, when the middle pressure communication hole 120*a* of the low pressure cylinder 121 and the middle pressure communication hole 140*a* of the middle plate 140 are formed in a spiral or circular arc shape, since the fastening holes 161*b*, 120*b*, 130*b*, 140*b* and 162*b* are formed in the centers of the spiral or circular arc shapes, the fastening holes 161*b*, 120*b*, 130*b*, 140*b* and 162*b* can be dispersively arranged in the entire compression assembly 105.

Figure 9:
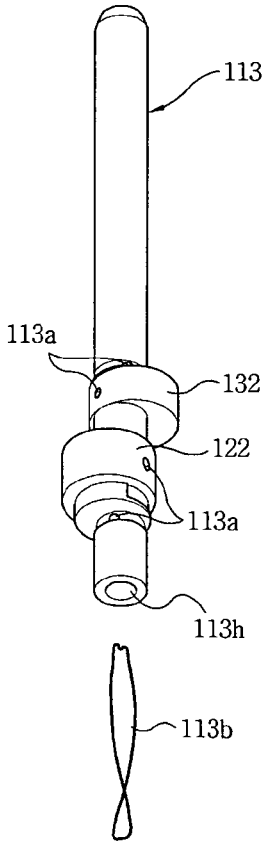
FIG. 9 is a view illustrating one example of a rotation axis provided in the 2 stage rotary compressor according to one embodiment of the present invention.

FIG. 9 is a view illustrating one example of the rotation axis provided in the 2 stage rotary compressor according to the present invention. A low pressure eccentric portion 122 and a high pressure eccentric portion 132 are coupled to the rotation axis 113. In order to reduce vibration, the low pressure eccentric portion 122 and the high pressure eccentric portion 132 are generally coupled to the rotation axis 113 with a phase difference of 180°. In addition, the rotation axis 113 is a hollow axis, and oil communication holes 103*a* are formed below the low pressure eccentric portion 122 and over the high pressure eccentric portion 132. Moreover, a thin-plate stirrer 103*b* bent in a spiral shape is inserted into the rotation axis 113. The stirrer 103*b* is fitted into the rotation axis 113 and rotated with the rotation axis 113 during the rotation of the rotation axis 113. When the stirrer 103*b* is rotated due to the rotation of the rotation axis 113, oil filled in a lower portion of the hermetic container 101 (see FIG. 4) is lifted along the inside of the rotation axis 113 by means of the stirrer 103*b*. Some oil is discharged to the low pressure cylinder 121, the middle plate 140 and the high pressure cylinder 131 through the oil communication holes 103*a* formed in the rotation axis 113, thereby lubricating the low pressure roller 123 (see FIG. 5) and a high pressure roller (not shown).

Figure 10:
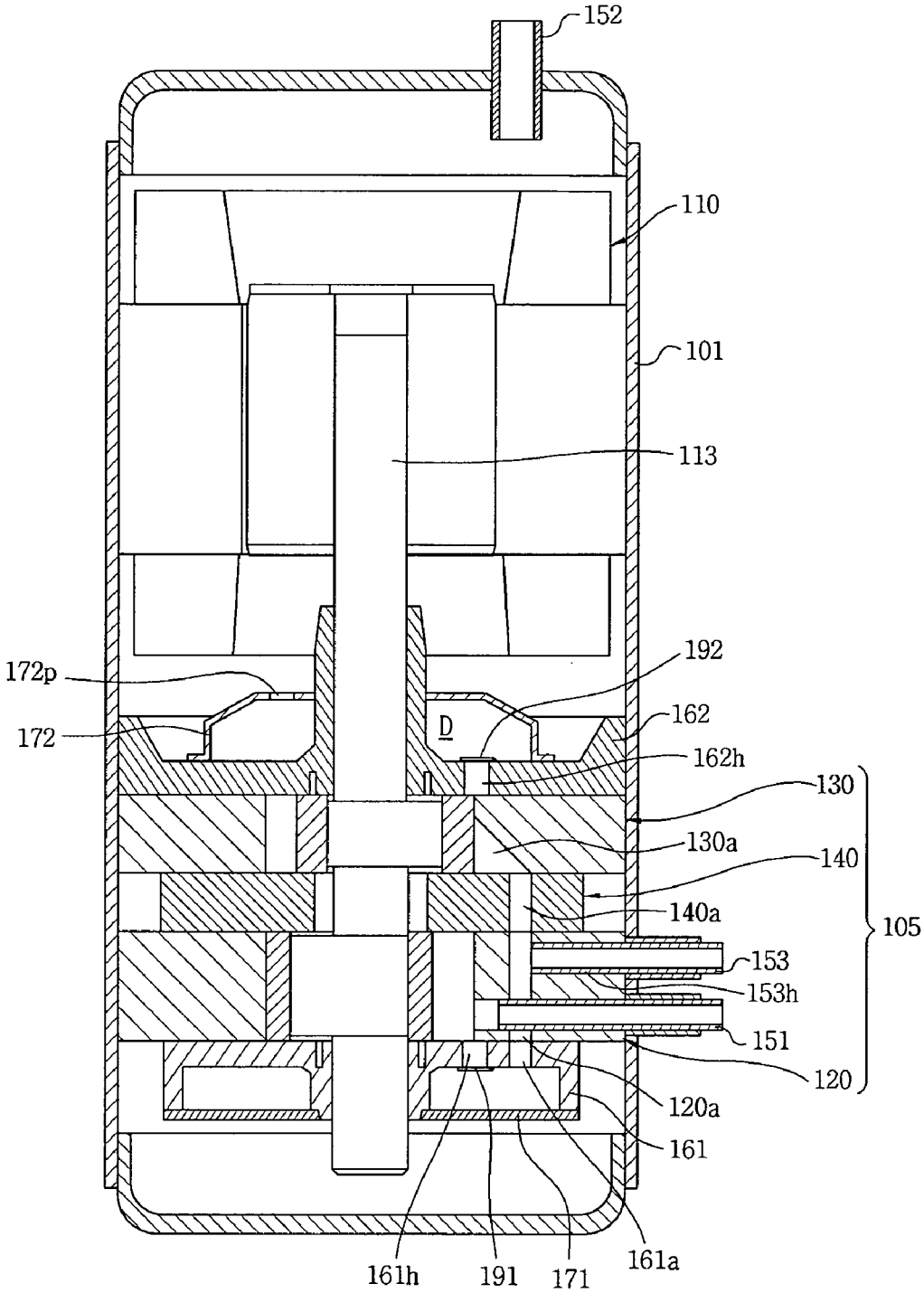
FIG. 10 is a view illustrating a 2 stage rotary compressor with an injection tube installed therein according to a first embodiment of the present invention.

FIG. 10 is a view illustrating a compressor with an injection tube inserted thereinto according to a first embodiment of the present invention. In a 2 stage compressor 100 according to the present invention, since an inner passage 180 is not a separate tube, an injection tube 153 for injecting refrigerant gas separated in a phase separator 500 may be installed in any portion of the inner passage 180. For example, a through hole 153*h* is formed in any one of a lower bearing 161, a middle plate 140 and a high pressure cylinder 131 constituting a middle pressure chamber $P_m$, and the injection tube 153 is inserted into the through hole 153*h* so as to inject refrigerant gas. As shown in FIG. 8, in a state where the through hole 153*h* is formed to pass through a middle pressure discharge hole 127 of a low pressure cylinder 121 or formed in the lower bearing 161, when the injection tube 153 is inserted into the through hole 153*h*, a pressure loss occurs along the middle pressure chamber $P_m$ and the inner passage 180. However, although liquid phase refrigerant is introduced through the injection tube 153, it is collected in a lower portion of the middle pressure chamber $P_m$, so that the compressor 100 can be stably operated.

Figure 11:
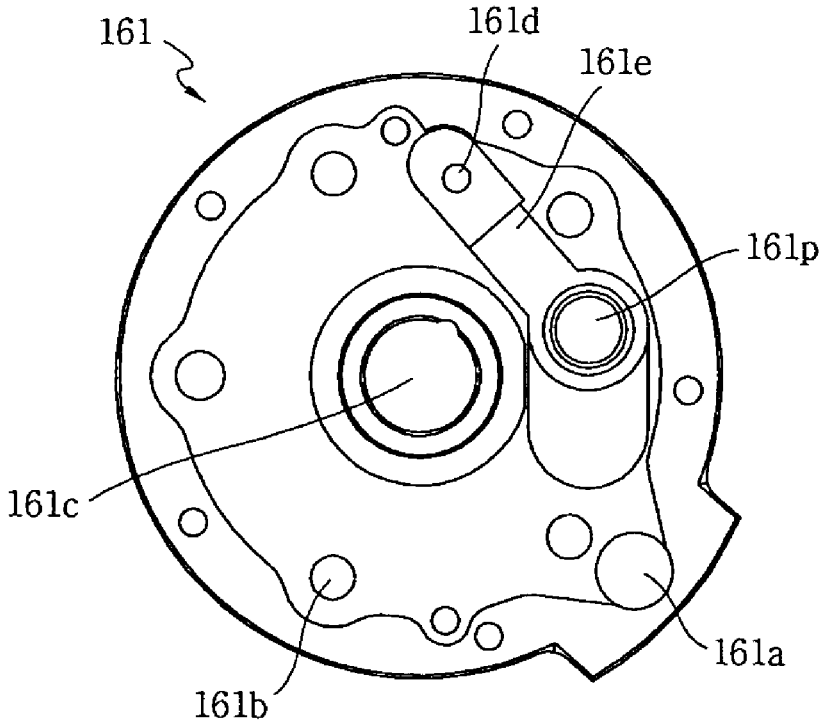
FIG. 11 is a view illustrating a lower bearing having a first discharge port according to the first embodiment of the present invention.

FIG. 11 is a view illustrating a lower bearing having a first discharge port according to the first embodiment of the present invention. The lower bearing 161 includes a first discharge port 161*p*, a middle pressure communication hole 161*a*, a fastening hole 161*b*, a rotation axis through hole 161*c*, a discharge valve fastening hole 161*d* and a discharge valve reception groove 161*e*.

According to the first embodiment of the present invention, a 2 stage compression assembly 105 (see FIG. 4), wherein a low pressure compression assembly 120 (see FIG. 4), a middle plate 140 (see FIG. 4) and a high pressure compression assembly 130 (see FIG. 4) are successively stacked from the bottom, is accommodated in a hermetic container 101 (see FIG. 4).

In addition, the compressor 100 includes the lower bearing 161 under the low pressure compression assembly 120 (see FIG. 4), and a lower cover 171 (see FIG. 4) under the lower bearing 161. Here, a space between the lower bearing 161 and the lower cover 171 serves as the middle pressure chamber $P_m$. The first discharge port 161*p* is formed in a top surface of the lower bearing 161, i.e., a surface which is in contact with a bottom surface of the low pressure compression assembly 120 (see FIG. 4). Middle pressure refrigerant compressed in the low pressure compression assembly 120 (see FIG. 4) is introduced into the middle pressure chamber $P_m$ through the middle pressure discharge hole 127 (see FIG. 5) formed in the low pressure cylinder 121 (see FIG. 5) and the first discharge port 161*p*, and guided to the high pressure compression assembly 130 (see FIG. 4) through the inner passage 180 (see FIG. 4).

Moreover, a discharge valve (not shown) for opening and closing the first discharge port 161*p* is provided on the top surface of the lower bearing 161. For example, the discharge valve (not shown) is a thin valve. One end of the discharge valve (not shown) is fastened to the lower bearing 161 by a fastening member. Therefore, the lower bearing 161 includes the fastening hole 161*d* to which the discharge valve (not shown) is to be fastened. Moreover, the lower bearing 161 includes the discharge valve reception groove 161*e* for receiving the discharge valve (not shown). The discharge valve (not shown) is set to open the discharge port 161*p* over a predetermined pressure. Here, the pressure imparted to the discharge valve (not shown) is the sum of a positive pressure by a discharge stroke of the low pressure compression assembly 120 (see FIG. 4) and a negative pressure by a suction stroke of the high pressure compression assembly 130 (see FIG. 4).

Figure 12:
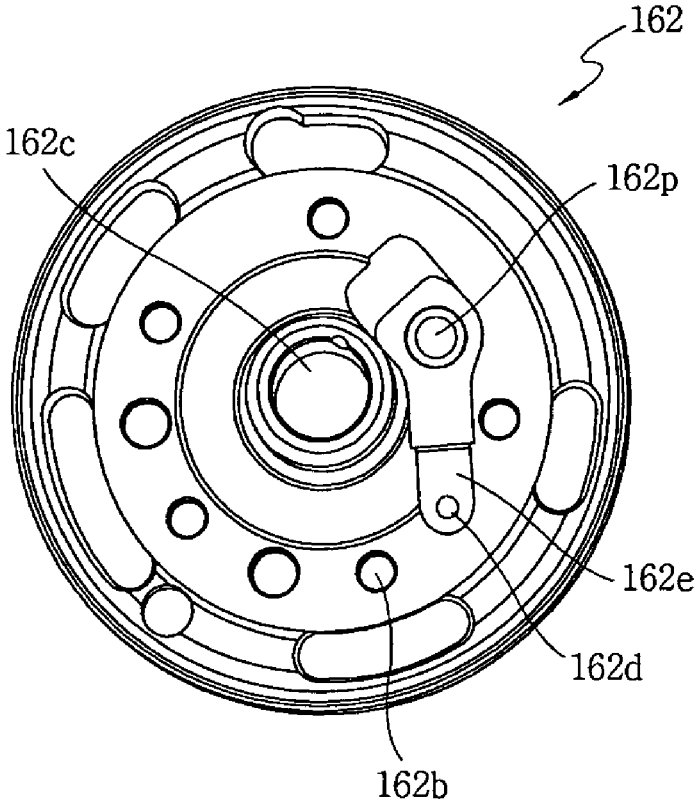
FIG. 12 is a view illustrating an upper bearing having a second discharge port according to the first embodiment of the present invention.

FIG. 12 is a view illustrating an upper bearing having a second discharge port according to the first embodiment of the present invention. An upper bearing 162 includes a second discharge port 162*p*, a fastening hole 162*b*, a rotation axis through hole 162*c*, a discharge valve fastening hole 162*d* and a discharge valve reception groove 162*e*. According to the first embodiment of the present invention, the upper bearing 162 is positioned on the 2 stage compression assembly 105 (see FIG. 4), and stacked so that a top surface of the high pressure compression assembly 130 and a bottom surface of the upper bearing 162 can be in contact with each other. The second discharge port 162*p* for discharging high pressure refrigerant compressed in the high pressure compression assembly 130 is formed in the upper bearing 162. In addition, an upper cover 172 (see FIG. 4) is positioned on the upper bearing 162, and a space defined by the upper bearing 162 and the upper cover 172 (see FIG. 4) functions as a muffler for reducing pulsation, vibration and noise.

A thin discharge valve (not shown) is formed on the second discharge port 162*p* to open and close the second discharge port 162*p* like the first discharge port 161*p* (see FIG. 11). The upper bearing 162 includes the discharge valve fastening hole 162*d* to which the discharge valve (not shown) is to be fastened, and the discharge valve reception groove 162*e* for receiving the discharge valve (not shown) when the discharge valve (not shown) closes the second discharge port 162*p*. The discharge valve (not shown) opens the second discharge port 162*p* over a set pressure. High pressure refrigerant compressed in the high pressure compression assembly 130 (see FIG. 4) is pulsation-reduced in the space between the upper bearing 162 and the upper cover 172 (see FIG. 4) due to opening of the second discharge port 162*p*, and discharged to the hermetic container 101 (see FIG. 4).

Referring to FIGS. 11 and 12, the first discharge port 161*p* and the second discharge port 162*p* are generally formed in the shape of a cylindrical hole due to processing convenience. Therefore, volumes of the first discharge port 161*p* and the second discharge port 162*p* can be easily computed by a formula of computing a volume of a cylinder. That is, the volumes of the first discharge port 161*p* and the second discharge port 162*p* can be computed by inner diameters and heights thereof.

Figure 13:
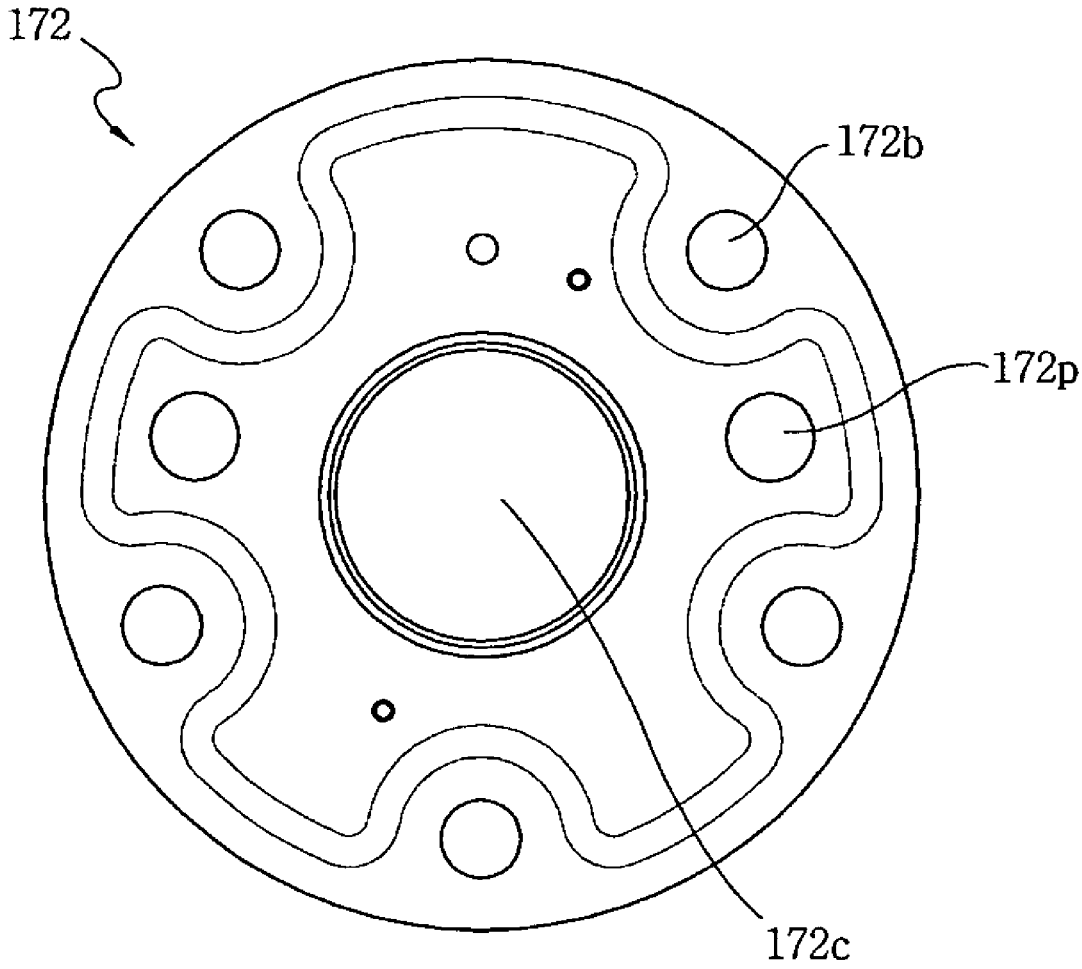
FIG. 13 is a view illustrating one example of an upper cover having a third discharge port provided in the 2 stage rotary compressor according to the first embodiment of the present invention.

FIG. 13 is a view illustrating one example of an upper cover having a third discharge port provided in the 2 stage rotary compressor according to the present invention. The third discharge port may be positioned at any one of upper and lower portions of the 2 stage compression assembly 105 (see FIG. 4) according to the stacked order of the 2 stage compression assembly 105 (see FIG. 4). In this embodiment, the third discharge port is formed at the upper portion by way of example.

The upper cover 172 is positioned on the upper bearing 162 (see FIG. 4) to constitute a muffler with the upper bearing 162 (see FIG. 4). The upper cover 172 is formed in the shape of a cap on the upper bearing 162 (see FIG. 4) so as to provide a space of temporarily storing compressed air from the high pressure compression assembly 130 (see FIG. 4) to reduce vibration and noise. A rotation axis through hole 172*c* is formed in a central portion of the upper cover 172 to pass the rotation axis 113 (see FIG. 4) therethrough. In addition, a fastening hole 172*b* into which a fastening member is to be inserted is formed in the upper cover 172 so that the upper cover 172 can be fastened to the upper bearing 162 (see FIG. 4). The portion except the fastening hole 172*b* is upwardly protruded to define the space functioning as the muffler. High pressure refrigerant gas discharged through the second discharge port 162*p* (see FIG. 12) formed in the upper bearing 162 (see FIG. 4) is temporarily stored in the space defined between the upper cover 172 and the upper bearing 162, and discharged to the hermetic container 101 (see FIG. 4) through the third discharge port 172*p* with vibration and pulsation reduced. Here, preferably, two third discharge ports 172*p* are formed at both sides of the upper cover 172.

Here, an area of the third discharge port 172*p* preferably has a value larger than 0.5 times of an area of the first discharge port 161*p* (see FIG. 11) and smaller than 1.0 times thereof. In a case where the third discharge port 172*p* is formed in the upper cover 172 in a plural number, the gum of areas of the plurality of third discharge ports 172*p* preferably has a value within the aforementioned range.

Figure 14:
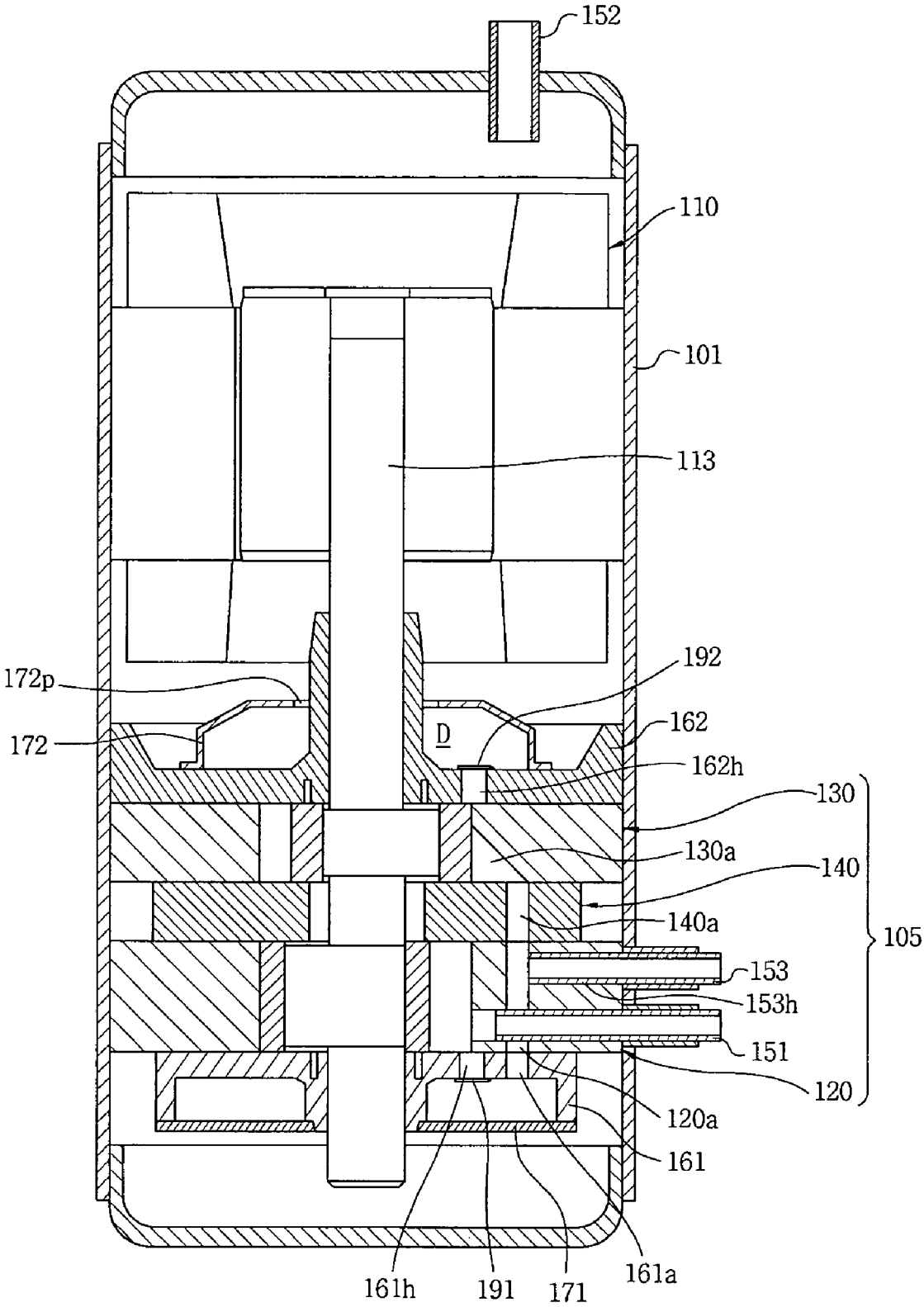
FIG. 14 is a view illustrating a 2 stage rotary compressor according to a second embodiment of the present invention.

FIG. 14 is a view illustrating a 2 stage rotary compressor according to a second embodiment of the present invention. A third discharge port 172*p* is positioned in a central portion of an upper cover 172. A rotation axis 113 and a portion of an upper bearing 162 coupled to the rotation axis 113 pass through the upper cover 172. Here, a gap between a boss groove formed in the upper bearing 162 and the upper bearing 162 passing through the boss groove becomes the third discharge port 172*p*. An area of the third discharge port 172*p* is a value obtained by subtracting an area of the portion of the upper bearing 162 passing through the boss groove from an area of the boss groove. As in the first embodiment, the area of the third discharge port 172*p* preferably has a value larger than 0.5 times of an area of a first discharge port 161*p* (see FIG. 11) and smaller than 1.0 times thereof.

Figure 15:
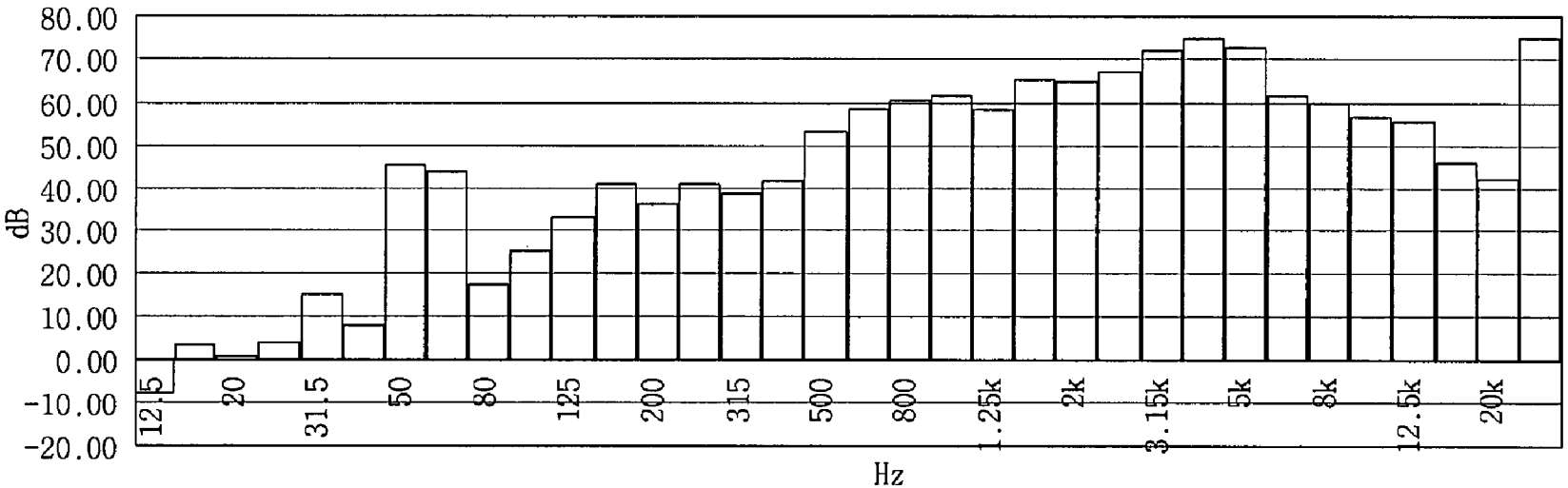
FIG. 15 is a graph showing a noise spectrum of the conventional 2 stage rotary compressor.

FIG. 15 is a graph showing a noise spectrum of a conventional 2 stage rotary compressor. Since an area of a third discharge port is not optimized, 78 dB of noise is generated near 5 kHz.

Figure 16:
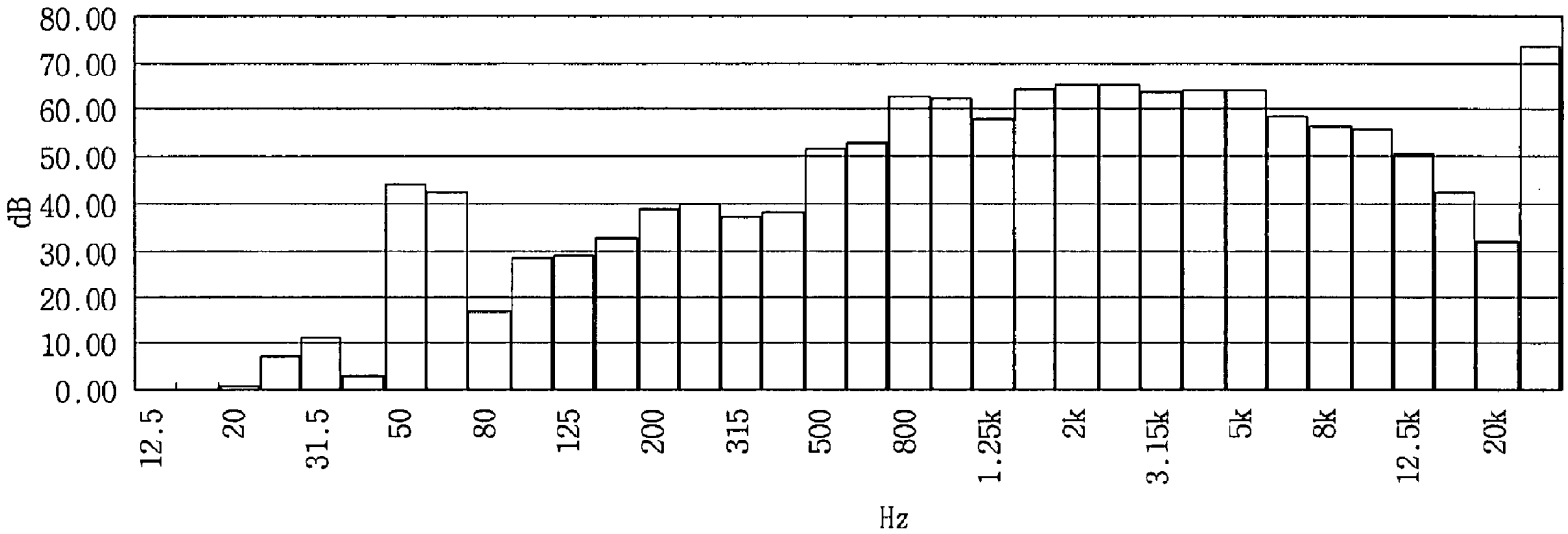
FIG. 16 is a graph showing a noise spectrum of the 2 stage rotary compressor according to the first embodiment of the present invention.

FIG. 16 is a graph showing a noise spectrum of the 2 stage rotary compressor according to one embodiment of the present invention. As compared with FIG. 15, noise is reduced to about 72 dB near 5 kHz showing the highest noise in the prior art, and noise is entirely reduced.

The first, second and third discharge ports of the 2 stage rotary compressor are not portions manually discharging compressed refrigerant. The sizes of the respective discharge ports operate as factors of determining friction and speed of fluid flowing through the respective discharge ports. As a result, energy efficiency and operation noise of the 2 stage rotary compressor are changed according to the sizes of the respective discharge ports, a size ratio of the respective cylinders, and a size ratio of the respective discharge ports. In addition, since two compression elements are coupled to one rotation axis with a phase difference of 180° and rotated to compress refrigerant in the 2 stage compressor, the design of the discharge ports greatly influences efficiency of the compressor. According to the present invention, efficiency of the 2 stage rotary compressor can be maximized and noise thereof can be minimized by restricting the sizes of the first, second and third discharge ports without changing the other constituent elements.

That is, on the basis of a fact that noise of the 2 stage rotary compressor may occur when refrigerant is supplied to and discharged from each compression assembly, the sizes of the discharge ports are optimized to minimize noise of the 2 stage rotary compressor. Moreover, on the basis of a fact that a volume of refrigerant may be changed when refrigerant is supplied to and discharged from each compression assembly, the sizes of the discharge ports are optimized to maximize efficiency of the 2 stage rotary compressor.

Figure 17:
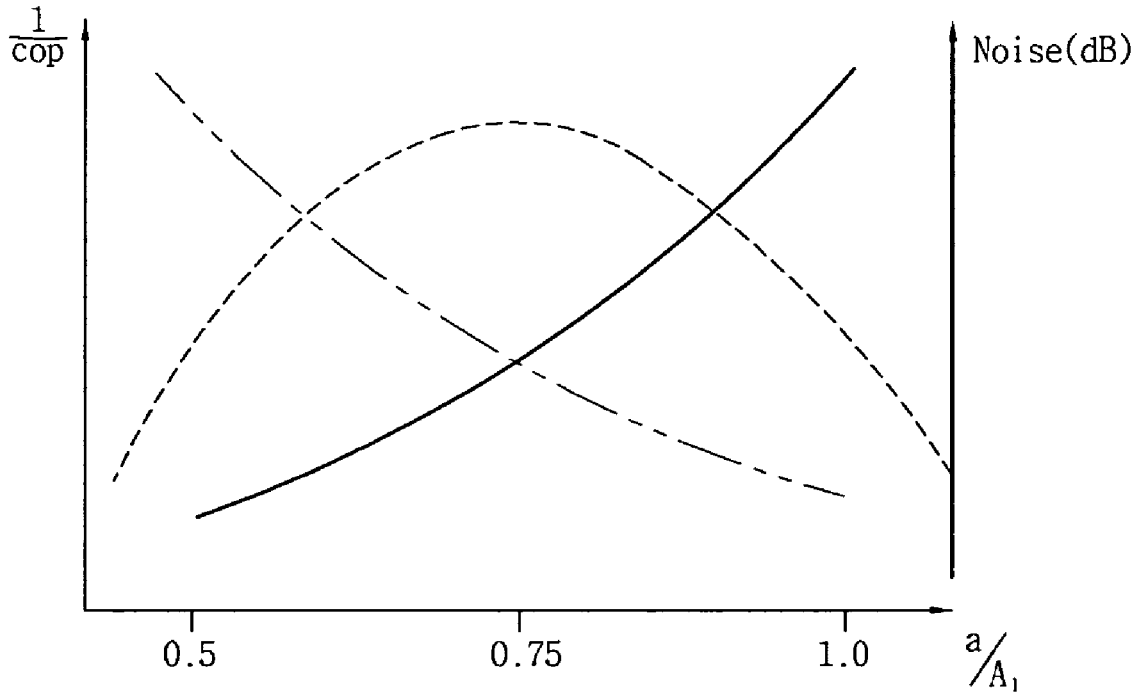
FIG. 17 is a graph showing performance, noise and optimization curves by a ratio of the third discharge port to the first discharge port.

FIG. 17 is a graph showing performance (1/COP), noise (dB) and optimization curves by a ratio of the third discharge port to the first discharge port of the 2 stage rotary compressor according to one embodiment of the present invention. A1 denotes an area of the first discharge port, and a denotes an area of the third discharge port. In a case where the third discharge port is provided in a plural number, a is the sum of areas of the plurality of discharge ports. Referring to FIG. 17, when a ratio of a to A1 is increased, noise is increased. However, when the ratio of a to A1 is increased, 1/COP is decreased, i.e., COP is improved. Therefore, an optimization curve inversely proportional to increase of noise and decrease of COP forms a parabola like a curve indicated by a dotted line in the drawing. Accordingly, the ratio of a to A1, i.e., the ratio of the area of the third discharge port to the area of the first discharge port preferably has a value between 0.5 and 1.0. Particularly, more preferably, the ratio approximates 0.75. The ratio of the area of the third discharge port to the area of the first discharge port is determined to optimize efficiency and noise of the 2 stage rotary compressor.

The schematic operation principle of the 2 stage rotary compressor according to one embodiment of the present invention will be explained with reference to FIGS. 3 to 13.

Refrigerant circulated in the freezing cycle is temporarily stored in the accumulator 200 before being introduced into the compressor 100. The accumulator 200 serves as a temporary storage space of refrigerant and functions as a gas-liquid separator to introduce only gas into the compressor 100. Gaseous refrigerant flows from the accumulator 200 to the low pressure cylinder 121 of the low pressure compression assembly 120 through the refrigerant inflow tube 151. The refrigerant inflow tube 151 penetrates through the hermetic container 101 and is fixed to the hermetic container 101 by means of welding. In addition, the refrigerant inflow tube 151 is inserted into the refrigerant inflow hole 126 formed in the low pressure cylinder 121. The refrigerant inflow hole 126 is formed to reach the inner diameter of the low pressure cylinder 121. The refrigerant introduced into the inner space of the low pressure cylinder 121 through the refrigerant inflow hole 126 is compressed by volume variations of the spaces defined by the low pressure cylinder 121, the low pressure roller 123 and the low pressure vane 124 due to relative motion of the low pressure cylinder 121 and the low pressure roller 123. The compressed refrigerant is transferred from the low pressure cylinder 121 to the high pressure cylinder 131 through the inner passage 180, and compressed by the high pressure compression assembly 130.

The inner passage 180 is connected to cause middle pressure refrigerant to flow from the low pressure cylinder 121 to the high pressure cylinder 131 by way of the middle pressure discharge hole 127 of the low pressure cylinder 121, the middle pressure chamber $P_m$, the middle pressure communication hole 161*a* of the lower bearing 161, the middle pressure communication hole 120*a* of the low pressure cylinder 121, the middle pressure communication hole 140*a* of the middle plate 140, and the middle pressure inflow groove 130*a* of the high pressure cylinder 131. Here, the middle pressure chamber $P_m$ may be replaced by a pipe or may be omitted.

That is, the refrigerant compressed by the low pressure compression assembly 120 is discharged to the middle pressure chamber $P_m$ formed below the low pressure cylinder 121 through the middle pressure discharge hole 127 formed in the low pressure cylinder 121. The middle pressure chamber $P_m$ is defined by the lower bearing 161 and the lower cover 171. In addition, the middle pressure discharge hole 161*h* is formed in the lower bearing 161 to overlap with the middle pressure discharge hole 127 of the low pressure cylinder 121. Moreover, a valve 191 for opening and closing the middle pressure discharge hole 161*h* is installed on the lower bearing 161. The valve 191 opens the middle pressure discharge hole 127 of the low pressure cylinder 121 and the middle pressure discharge hole 161*h* of the lower bearing 161 over a set pressure. Middle pressure refrigerant discharged to the middle pressure chamber $P_m$ due to opening of the valve 191 is introduced into the inner space of the high pressure cylinder 131 through the middle pressure communication hole 161*a* of the lower bearing 161, the middle pressure communication hole 120*a* of the low pressure cylinder 121, the middle pressure communication hole 140*a* of the middle plate 140 and the middle pressure inflow groove 130*a* of the high pressure cylinder 131. Here, the injection tube 153 is connected to the middle pressure communication hole 120*a* of the low pressure cylinder 121 so as to inject gaseous refrigerant separated in the phase separator 500 into the inner passage 180. Refrigerant separated in the phase separator 500 has a higher pressure than refrigerant passing through the evaporator 400. Therefore, when the refrigerant separated in the phase separator 500 is introduced into the high pressure compression assembly 130 with the refrigerant compressed in the low pressure compression assembly 120, compressed and discharged, input power of the compressor 200 can be reduced.

The refrigerant separated in the phase separator 500 and the refrigerant compressed in the low pressure compression assembly 120 are introduced into the high pressure cylinder 131 through the middle pressure inflow groove 130*a* of the high pressure cylinder 131, and compressed to a high pressure by the high pressure compression assembly 130 in the same operation principle as that of the low pressure compression assembly 120. The refrigerant compressed to a high pressure in the high pressure compression assembly 130 is discharged to a discharge space D defined between the upper bearing 162 and the upper cover 172 through a high pressure discharge hole 137 of the high pressure cylinder 131 and a high pressure discharge hole 162*h* of the upper bearing 162. Here, a valve 192 is installed on the upper bearing 162 to open and close the high pressure discharge hole 137 of the high pressure cylinder 131 and the high pressure discharge hole 162*h* of the upper bearing 162. Accordingly, only when refrigerant is compressed in the high pressure compression assembly 130 over a pre-determined pressure, the valve 192 opens the high pressure discharge hole 137 of the high pressure cylinder 131 and the high pressure discharge hole 162*h* of the upper bearing 162, thereby discharging refrigerant to the discharge space D. High pressure refrigerant is temporarily stored in the discharge space D, and then discharged to the top of the hermetic container 101 through the discharge port 172*p* of the upper cover 172. The high pressure refrigerant is filled in the hermetic container 101. The high pressure refrigerant filled in the hermetic container 101 is discharged to the outside through the discharge tube 152 passing through the upper portion of the hermetic container 101, circulated in the freezing cycle, introduced into the compressor 100 again through the accumulator 200 and the phase separator 500, and compressed in the compressor 100.

Moreover, lubrication oil for lubricating the compression assembly 105 is filled in the lower portion of the hermetic container 101. The lubrication oil is lifted along the inside of the rotation axis 113 due to the rotation of the stirrer 103*b* inserted into the rotation axis 113, and supplied to the low pressure compression assembly 120 and the high pressure compression assembly 130 through the oil communication holes 103*a* formed in the rotation axis 113 to lubricate the compression assembly 105. Further, the oil may be supplied to the low pressure compression assembly 120 and the high pressure compression assembly 130 through the vane holes

124*h* and 134*h* formed in the low pressure cylinder 121 and the high pressure cylinder 131 to lubricate the compression assembly 105.

The invention claimed is:

1. A 2 stage rotary compressor, comprising:

a hermetic container;

a 2 stage compression assembly provided in the hermetic container, wherein a low pressure compression assembly, a middle plate and a high pressure compression assembly are successively stacked from any one of upper and lower portions;

a first discharge port for discharging middle pressure refrigerant compressed in the low pressure compression assembly; a second discharge port for discharging high pressure refrigerant compressed in the high pressure compression assembly; and a third discharge port positioned at any one of the upper and lower portions of the 2 stage compression assembly to discharge high pressure refrigerant compressed in the 2 stage compression assembly to the hermetic container, wherein an area of the third discharge port is larger than 0.5 times of an area of the first discharge port and smaller than 1.0 times thereof.

2. The 2 stage rotary compressor of claim 1, further comprising a muffler positioned on the 2 stage compression assembly to temporarily store refrigerant discharged from the second discharge port, wherein the third discharge port is formed in the muffler.

3. The 2 stage rotary compressor of claim 2, wherein the muffler comprises a bearing and a cover.

4. The 2 stage rotary compressor of claim 1, wherein two or more third discharge ports are formed.

5. The 2 stage rotary compressor of claim 1, further comprising a passage for guiding middle pressure refrigerant discharged through the first discharge port to the high pressure compression assembly.

6. The 2 stage rotary compressor of claim 5, wherein the passage is defined by a U-shaped tube passing through the hermetic container.

7. The 2 stage rotary compressor of claim 5, wherein the passage is an inner passage defined by a hole processed in the 2 stage compression assembly.

8. The 2 stage rotary compressor of claim 5, further comprising an injection tube coupled to the passage.

9. A 2 stage rotary compressor, comprising:

a hermetic container;

a 2 stage compression assembly provided in the hermetic container, wherein a low pressure compression assembly, a middle plate and a high pressure compression assembly are successively stacked from any one of upper and lower portions;

a first discharge port for discharging middle pressure refrigerant compressed in the low pressure compression assembly;

a second discharge port for discharging high pressure refrigerant compressed in the high pressure compression assembly; and a third discharge port positioned at any one of the upper and lower portions of the 2 stage compression assembly to discharge high pressure refrigerant compressed in the 2 stage compression assembly to the hermetic container, wherein an area of the third discharge port is larger than 0.5 times of an area of the second discharge port and smaller than 1.0 times thereof.

10. The 2 stage rotary compressor of claim 1, wherein a diameter of the second discharge port is equivalent to 0.5 to 1.0 times of a diameter of the first discharge port.

11. A 2 stage rotary compressor, comprising:

a hermetic container;

a low pressure cylinder provided in the hermetic container to define a space of compressing low pressure refrigerant;

a high pressure cylinder provided in the hermetic container to define a space of compressing middle pressure refrigerant compressed in the low pressure cylinder;

a muffler formed in the shape of a cap and coupled to the high pressure cylinder to reduce noise of compressed high pressure refrigerant;

a middle pressure discharge hole formed in the low pressure cylinder to discharge refrigerant compressed to a middle pressure; and a high pressure discharge hole formed in the muffler, and larger than 0.5 times of an area of the middle pressure discharge hole and smaller than 1.0 times thereof.

12. The 2 stage rotary compressor of claim 11, wherein the high pressure discharge hole formed in the muffler is formed in a plural number, and the sum of areas of the high pressure discharge holes is larger than 0.5 times of the area of the middle pressure discharge hole and smaller than 1.0 times thereof.

13. The 2 stage rotary compressor of claim 11, wherein the middle pressure discharge hole communicates with the compression space of the high pressure cylinder.

14. The 2 stage rotary compressor of claim 13, wherein the middle pressure discharge hole and the compression space of the high pressure cylinder communicate with each other by means of a U-shaped tube passing through the hermetic container.

15. The 2 stage rotary compressor of claim 13, further comprising a middle plate positioned between the low pressure cylinder and the high pressure cylinder, wherein the middle pressure discharge hole and the compression space of the high pressure cylinder communicate with each other by means of a hole formed in the middle plate.

16. A 2 stage rotary compressor, comprising:

a hermetic container;

a low pressure cylinder provided in the hermetic container to define a space of compressing low pressure refrigerant;

a high pressure cylinder provided in the hermetic container to define a space of compressing middle pressure refrigerant compressed in the low pressure cylinder;

a muffler formed in the shape of a cap and coupled to the high pressure cylinder to reduce noise of compressed high pressure refrigerant;

a high pressure discharge hole formed in the high pressure cylinder to discharge refrigerant compressed to a high pressure; and a high pressure discharge hole formed in the muffler, and larger than 0.5 times of an area of the high pressure discharge hole formed in the high pressure cylinder and smaller than 1.0 times thereof.

17. The 2 stage rotary compressor of claim 16, further comprising a middle pressure discharge hole formed in the low pressure cylinder to discharge refrigerant compressed to a middle pressure, wherein a diameter of the high pressure discharge hole formed in the high pressure cylinder has a value between 0.5 and 1.0 times of a diameter of the middle pressure discharge hole.

18. The 2 stage rotary compressor of claim 17, wherein the middle pressure discharge hole communicates with the compression space of the high pressure cylinder.

19. The 2 stage rotary compressor of claim 18, wherein the middle pressure discharge hole and the compression space of the high pressure cylinder communicate with each other by means of a U-shaped tube passing through the hermetic container.

20. The 2 stage rotary compressor of claim 18, further comprising a middle plate positioned between the low pressure cylinder and the high pressure cylinder, wherein the middle pressure discharge hole and the compression space of the high pressure cylinder communicate with each other by means of a hole formed in the middle plate.

* * * * *